US008734309B2

(12) United States Patent
Johns et al.

(10) Patent No.: US 8,734,309 B2
(45) Date of Patent: May 27, 2014

(54) FORMING DIE ASSEMBLY WITH ENHANCED STOP

(75) Inventors: Albert D. Johns, Saylorsburg, PA (US); Mircea T. Sofronie, Easton, PA (US)

(73) Assignee: Dixie Consumer Products LLC, Atlanta, GA (US)

( * ) Notice: Subject to any disclaimer, the term of this patent is extended or adjusted under 35 U.S.C. 154(b) by 0 days.

(21) Appl. No.: 11/465,697

(22) Filed: Aug. 18, 2006

(65) Prior Publication Data

US 2007/0042887 A1 Feb. 22, 2007
US 2008/0242525 A9 Oct. 2, 2008

Related U.S. Application Data

(60) Provisional application No. 60/709,649, filed on Aug. 19, 2005.

(51) Int. Cl.
*B31B 43/00* (2006.01)

(52) U.S. Cl.
CPC ..... *B31B 43/00* (2013.01); *B31B 2201/223* (2013.01); *Y10S 493/902* (2013.01)
USPC ..... 493/152; 493/167; 493/171; 493/174; 493/902

(58) Field of Classification Search
CPC .. B31B 2201/223; B31B 43/00; B29C 43/361
USPC ..... 493/76, 152, 143, 168, 171, 174, 902, 493/167; 425/191, 198, DIG. 29, 127, 335, 425/398, 400, 443; 264/320; 72/370.13
See application file for complete search history.

(56) References Cited

U.S. PATENT DOCUMENTS

| | | | | | |
|---|---|---|---|---|---|
| 1,793,089 | A | | 2/1931 | Heyes | |
| 2,136,308 | A | * | 11/1938 | Miller | 493/152 |
| 2,296,744 | A | * | 9/1942 | Simmons | 425/343 |
| 2,332,937 | A | | 10/1943 | Schmidberger | |
| 2,377,351 | A | * | 6/1945 | Martin | 425/394 |
| 2,492,886 | A | * | 12/1949 | Punte | 493/61 |
| 2,595,046 | A | | 4/1952 | Amberg | |
| 2,832,522 | A | | 4/1958 | Schlanger | |
| 3,305,434 | A | | 2/1967 | Bernier et al. | |
| 3,324,511 | A | * | 6/1967 | Micai et al. | 425/398 |
| 3,414,941 | A | * | 12/1968 | Ignell | 425/310 |
| 3,685,338 | A | * | 8/1972 | Hoffman | 72/348 |
| 3,824,058 | A | | 7/1974 | Axer et al. | |
| 3,868,919 | A | * | 3/1975 | Schrecker et al. | 413/13 |
| 3,995,763 | A | * | 12/1976 | Ayres et al. | 220/659 |
| 4,150,936 | A | | 4/1979 | Shioi et al. | |
| 4,228,121 | A | * | 10/1980 | Meadors | 264/291 |
| 4,242,293 | A | | 12/1980 | Dowd | |
| 4,381,278 | A | * | 4/1983 | Ingraffea | 264/512 |
| 4,571,978 | A | * | 2/1986 | Taube et al. | 72/349 |
| 4,580,962 | A | * | 4/1986 | Haas | 425/111 |

(Continued)

FOREIGN PATENT DOCUMENTS

JP 60135221 A * 7/1985 ..... B29C 43/42

*Primary Examiner* — Stephen F Gerrity
(74) *Attorney, Agent, or Firm* — William W. Letson

(57) ABSTRACT

A die assembly for producing paperboard pressware includes an obliquely angled, continuous ring, and/or annular stop member between an inner die member and an outer die ring. Increased surface area of contact between stop components provides greater wear resistance, and the angled contact face maintains alignment of the die components.

20 Claims, 7 Drawing Sheets

(56) References Cited

U.S. PATENT DOCUMENTS

| | | | | | |
|---|---|---|---|---|---|
| 4,588,539 | A | | 5/1986 | Rossi et al. | |
| 4,606,496 | A | | 8/1986 | Marx et al. | |
| 4,609,140 | A | | 9/1986 | Van Handel et al. | |
| 4,611,481 | A | * | 9/1986 | Radtke | 72/347 |
| 4,637,811 | A | * | 1/1987 | Fortney | 493/167 |
| 4,715,208 | A | * | 12/1987 | Bulso, Jr. et al. | 72/348 |
| 4,721,499 | A | | 1/1988 | Marx et al. | |
| 4,721,500 | A | | 1/1988 | Van Handel et al. | |
| 4,755,128 | A | | 7/1988 | Alexander et al. | |
| 4,781,047 | A | * | 11/1988 | Bressan et al. | 72/84 |
| 4,781,566 | A | | 11/1988 | Rossi et al. | |
| 4,808,052 | A | * | 2/1989 | Bulso, Jr. et al. | 413/8 |
| 4,824,357 | A | * | 4/1989 | Christiansen | 425/417 |
| 4,832,676 | A | | 5/1989 | Johns et al. | |
| 4,851,176 | A | * | 7/1989 | Christiansen et al. | 264/268 |
| 5,129,874 | A | | 7/1992 | Hayes, III et al. | |
| 5,203,491 | A | | 4/1993 | Marx et al. | |
| 5,249,946 | A | | 10/1993 | Marx | |
| 5,326,244 | A | * | 7/1994 | Ridgill et al. | 425/127 |
| 5,364,583 | A | | 11/1994 | Hayashi | |
| 5,693,346 | A | | 12/1997 | Dull et al. | |
| 6,139,307 | A | | 10/2000 | Plourde et al. | |
| 6,261,082 | B1 | | 7/2001 | Han | |
| 6,284,101 | B1 | | 9/2001 | Marx | |
| 6,527,687 | B1 | | 3/2003 | Fortney et al. | |
| 6,589,043 | B1 | | 7/2003 | Johns et al. | |
| 6,592,357 | B1 | | 7/2003 | Johns et al. | |
| 6,783,720 | B2 | | 8/2004 | Johns et al. | |
| 6,830,419 | B1 | * | 12/2004 | Turner et al. | 413/8 |
| 6,908,296 | B2 | | 6/2005 | Johns et al. | |
| 6,932,753 | B1 | | 8/2005 | Smith et al. | |
| 7,048,176 | B2 | | 5/2006 | Littlejohn et al. | |
| 8,047,834 | B2 | * | 11/2011 | Sofronie et al. | 425/394 |
| 8,414,464 | B2 | * | 4/2013 | Grischenko et al. | 493/167 |
| 8,430,660 | B2 | * | 4/2013 | Johns et al. | 425/193 |
| 2003/0173366 | A1 | * | 9/2003 | Littlejohn et al. | 220/574 |
| 2003/0205848 | A1 | * | 11/2003 | Johns et al. | 264/320 |
| 2005/0192171 | A1 | | 9/2005 | Grischenko et al. | |
| 2006/0208054 | A1 | | 9/2006 | Littlejohn et al. | |

* cited by examiner

FORMING DIE ASSEMBLY WITH ENHANCED STOP

CROSS-REFERENCE TO RELATED APPLICATION

This non-provisional application claims the benefit of U.S. Provisional Patent Application Ser. No. 60/709,649 filed Aug. 19, 2005, which is incorporated herein by reference in its entirety.

TECHNICAL FIELD

The present invention relates generally to the manufacture of pressware containers made from paperboard blanks, such as plates, bowls and platters; and relates more particularly to an enhanced stop mechanism for a forming die assembly, for reducing wear related maintenance and for providing improved alignment of the die components during operation.

BACKGROUND

Forming press systems for making pressware containers from paperboard are known in the art. Typically, a forming press system includes one or more forming die assemblies oriented on an inclined plane such that scored paperboard blanks are fed between upper and lower die components thereof by way of gravity. Generally, forming die assemblies include an upper male die member or "punch," and a lower female die member or "die," which are compressed together to shape and crimp the blank into the desired final product. The male and/or female die members can be provided with knock-out sections, and/or an air ejector system can be included for assisting in removal of the formed product from the forming press. U.S. Pat. No. 6,908,296 to Johns et al., U.S. Pat. No. 4,588,539 to Rossi et al., U.S. Pat. No. 6,592,357 to Johns et al., U.S. Pat. No. 4,242,293 to Dowd, U.S. Pat. Nos. 5,249,946 and 6,284,101 to Marx, and U.S. Pat. No. 3,824,058 to Axer et al. are incorporated herein for background teaching showing the state of the art.

As shown in FIGS. 1-3, forming die assemblies 10 having segmented punch and die mechanisms are known. These commonly include an outer pressure ring 20 mounted to surround an inner punch 22, and an outer draw ring 24 mounted to surround an inner die 26 (both the punch and die components of segmented forming die assemblies are sometimes referred to herein as inner die members, and both the pressure ring and draw ring components are sometimes referred to as outer die rings). The pressure ring 20 and draw ring 24 reciprocate independently of their respective inner die members over at least a portion of the forming stroke. As the forming die assembly is closed, the pressure ring 20 contacts the blank, clamping it against the draw ring 24 and die 26 to provide pleating control during formation. As the forming die assembly closes further, the punch 22 is pressed into the die 26 to form the desired product geometry between the mating punch and die profiles. Internal springs 28 normally bias the pressure ring 20 and the draw ring 24 toward their extended positions relative to the inner die members, as shown in FIG. 1. These springs are compressed as the forming press is closed, allowing the pressure ring and draw ring to remain in contact with the edge of the blank under controlled pressure as the inner die members independently advance into engagement with one another. At the completion of the forming die assembly's compression stroke, the pressure ring 20 and the draw ring 24 are positioned in their retracted positions relative to the inner die members, as shown in FIG. 2.

After completion of the compression stroke, the forming die assembly is opened to remove the shaped product, and the cycle is repeated. Opening of the forming die assembly causes the pressure ring 20 and the draw ring 24 to return under the influence of the internal springs, back into their extended positions relative to the inner die members, as shown in FIG. 1. Angle iron stops 30, 32 are typically attached to the pressure ring 20 and the draw ring 24 at circumferentially spaced apart locations, for abutment against flat shoulders of pockets machined into the side faces of the punch 22 and the die 26, respectively, to limit the extent of travel of the pressure ring and the draw ring relative to the inner die members on the return stroke of the forming die assembly.

Repeated impact of the stops 30, 32 against the punch 22 and the die 26 during high-speed cyclical operation, typically as part of a continuously operating process, often results in considerable wear damage to the stops. And because the stops 30, 32 are typically formed of a hardened steel extrusion having a higher hardness than the material of which the pressure ring 20, the draw ring 24, the punch 22, and the die 26 are formed, wear damage to the die components is also common. Misalignment of the die components resulting from such wear can result in damage to the pressure ring 20 and the draw ring 24. It has now been discovered that cyclical wear-related damage takes place at a relatively high rate in the areas of the stops 30, 32 because of the relatively small surface area of contact between the stops and the abutment shoulders of the inner die members (shown as the cross-hatched areas 60 in FIG. 3).

The relative positioning of the pressure ring 20 and the draw ring 24 with respect to the inner die members affects the pressure applied to the edge of the blank, which in turn effects the pleating control and edge formation of the final product. Thus, wear at the contact areas between the stops 30, 32 and the pressure ring 20 and draw ring 24 can adversely affect product quality. This is of particular concern in the manufacture of products having specialized rim and edge configurations for improved structural performance, such as for example the product geometries identified in U.S. patent application Ser. No. 10/963,686, filed Oct. 13, 2004, and incorporated herein by reference. As a result, replacement of worn or broken stops 30, 32 and/or pressure ring and draw ring components frequently becomes necessary in order to maintain a high degree of quality control. Replacement of these components results in substantial down-time of production equipment, as well as increased parts costs and man-hours of labor.

It has also now been discovered that the moving components of a forming die assembly often tend to move progressively out of alignment during use because of the assembly's inclined orientation. Without being bound by theory, it is believed that gravity tends to pull the pressure ring 20 and the draw ring 24 downwardly due to the assembly's inclined orientation, shifting the pressure ring and draw ring out of alignment with the inner die members. In addition, the weight of the pressure ring 20 also causes friction between the punch 22 and the stops 30 to be higher along the "uphill" side of the forming die assembly than along the "downhill" side. Similarly, friction between the die 26 and the stops 32 is higher along the "uphill" side due to the weight of the draw ring 24. Over a period of cyclical operation, the higher friction at the "uphill" side causes increased wear between the moving components, leading to progressively increasing misalignment. Even a small degree of off-center draw of the die components against the paperboard blanks resulting from such misalignment can have a very negative effect on proper formation of the rim edges of the final product. Because the edge geometry has a substantial effect on product rigidity, it is desirable to minimize misalignment of the forming die assembly's components during operation.

In view of these characteristics of known forming die assemblies, it can be seen that equipment and process improvements that reduce the incidence of wear-related damage and/or better maintain alignment of forming die assembly components during operation would be highly desirable in terms of improved product quality, greater productivity and increased profitability.

SUMMARY OF THE INVENTION

The present invention provides a forming die assembly with an improved stop mechanism. Example embodiments of the present invention reduce the incidence of wear-related damage to forming die assemblies and better maintain alignment of components thereof during operation, as compared to known equipment. As a result, maintenance costs and downtime may be decreased, product quality improved, and productivity and profitability increased.

In one aspect, an apparatus according to an example form of the present invention preferably includes an inner die member having a peripheral face, and an outer die ring surrounding the inner die member and translationally mounted thereon. The outer die ring preferably includes at least one stop having an internal contact face for abutment against a confronting portion of the peripheral face of the inner die member to limit translation of the outer die ring relative to the inner die member. The internal contact face is preferably angularly inclined relative to a translational axis of the outer die ring.

In another aspect, an apparatus according to an example form of the present invention preferably includes an outer die ring mounted to traverse a stroke along an inner die member. The outer die ring preferably includes at least one circumferential stop member having an annular contact face for limiting the stroke of the outer die ring.

In still another aspect, an apparatus according to an example form of the present invention preferably includes an inner die member having an outer peripheral face including at least one inner die member stop having an angularly-inclined external face, and an outer die ring surrounding the inner die member. The outer die ring preferably includes at least one die ring stop having an angularly-inclined internal face. The internal face of each die ring stop preferably engages against the external face of a corresponding inner die member stop to limit the travel of the outer die ring relative to the inner die member.

In another aspect, a die assembly according to an example form of the present invention is movable between an open position and a closed position. The die assembly preferably includes an upper die half comprising a punch and a pressure ring translationally mounted to the punch to traverse a stroke between an extended position corresponding to the open position of the die assembly and a retracted position corresponding to the closed position of the die assembly. The die assembly preferably also includes a lower die half comprising a die and a draw ring translationally mounted to the die to traverse a stroke between an extended position corresponding to the open position of the die assembly and a retracted position corresponding to the closed position of the die assembly. The die assembly preferably also includes a first stop mechanism for limiting the extended position of either or both of the pressure ring and/or the draw ring, the first stop mechanism including a ring stop having an angled contact face.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

Figure 1:
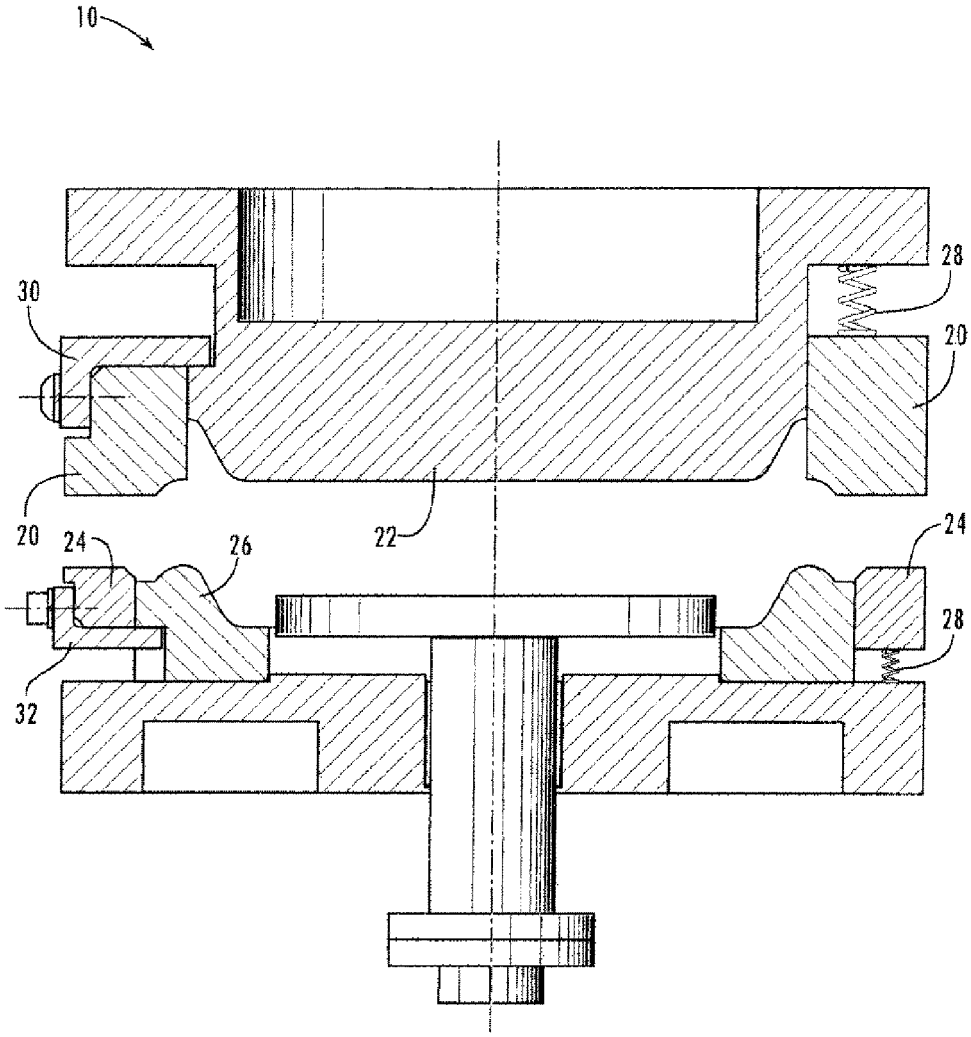
(PRIOR ART) Fig. 1
FIG. 1 is a cross-sectional view of a known forming die assembly for making paperboard pressware containers, shown in an open configuration.
Figure 2:
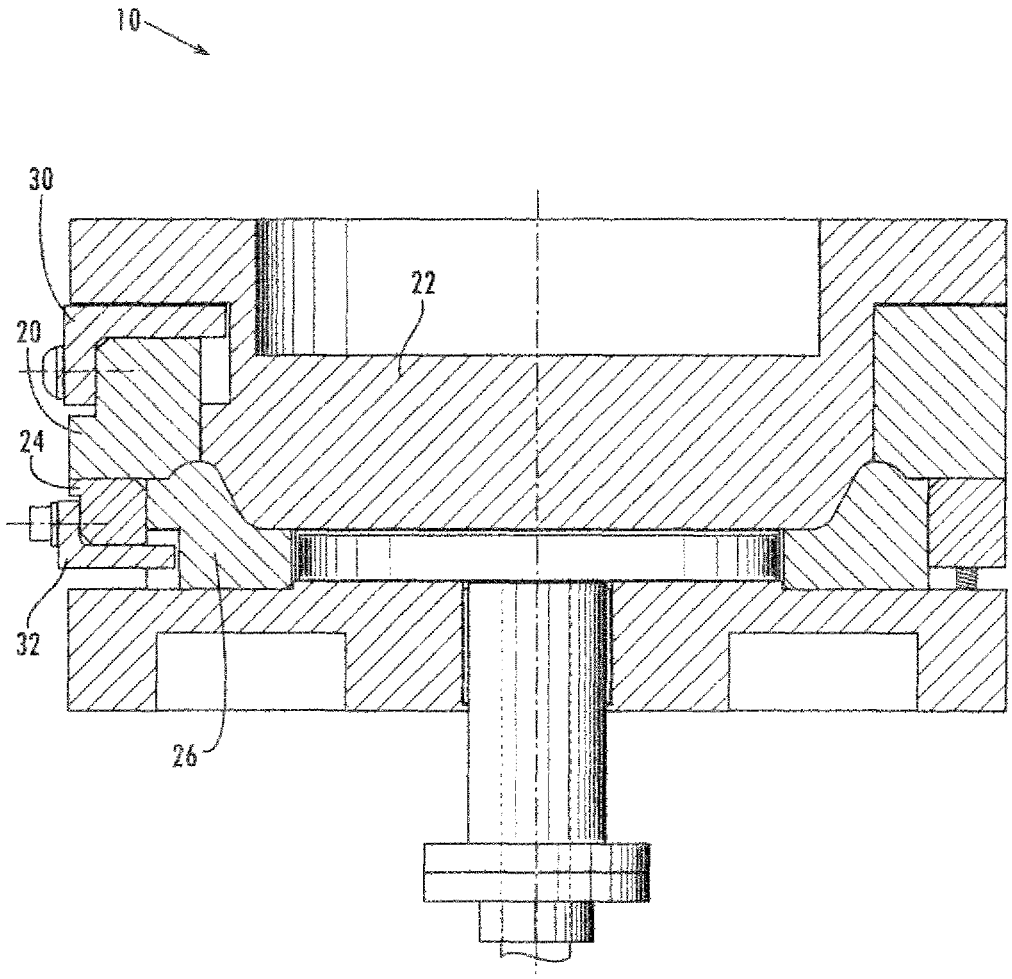
(PRIOR ART) Fig. 2
FIG. 2 shows the forming die assembly of FIG. 1 in a closed configuration.

The present invention may be understood more readily by reference to the following detailed description of the invention taken in connection with the accompanying drawing figures, which form a part of this disclosure. It is to be understood that this invention is not limited to the specific devices, dimensions or parameters described herein and/or shown in the drawing figures. Rather, the description and drawings provided are for the purpose of describing particular embodiments by way of example only, to assist in understanding the claimed invention, and are not intended to be limiting of the invention claimed. Also, the invention includes the overall systems and methods described herein, as well as the individual components and sub-combinations thereof, as claimed. As used herein, the singular forms "a," "an," and "the" are to be interpreted as including the plural, and reference to a particular numerical value includes at least that particular value, unless the context clearly dictates otherwise.

Figure 4:
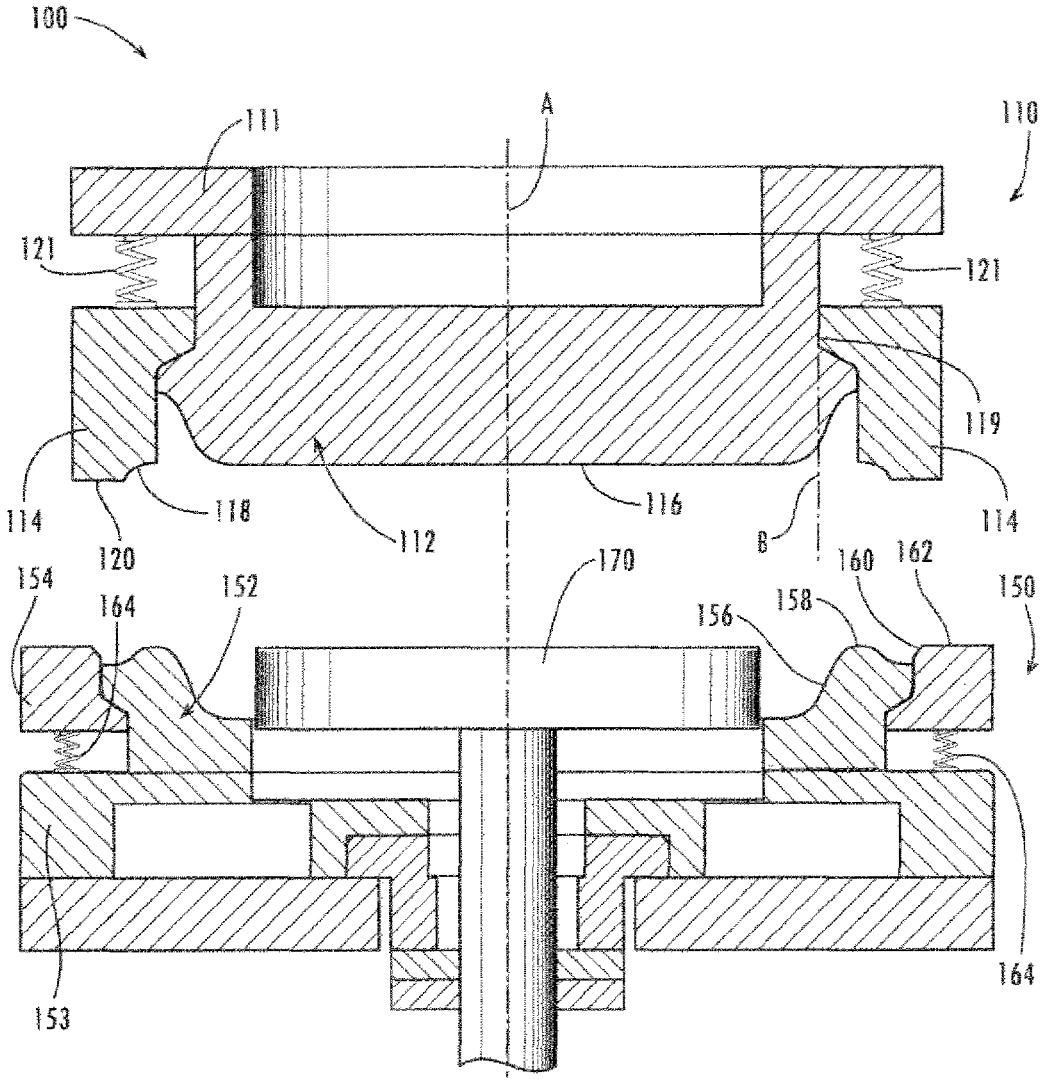
FIG. 4 is a cross-sectional view of a forming die assembly according to an example embodiment of the present invention, shown in an open configuration.
Figure 5:
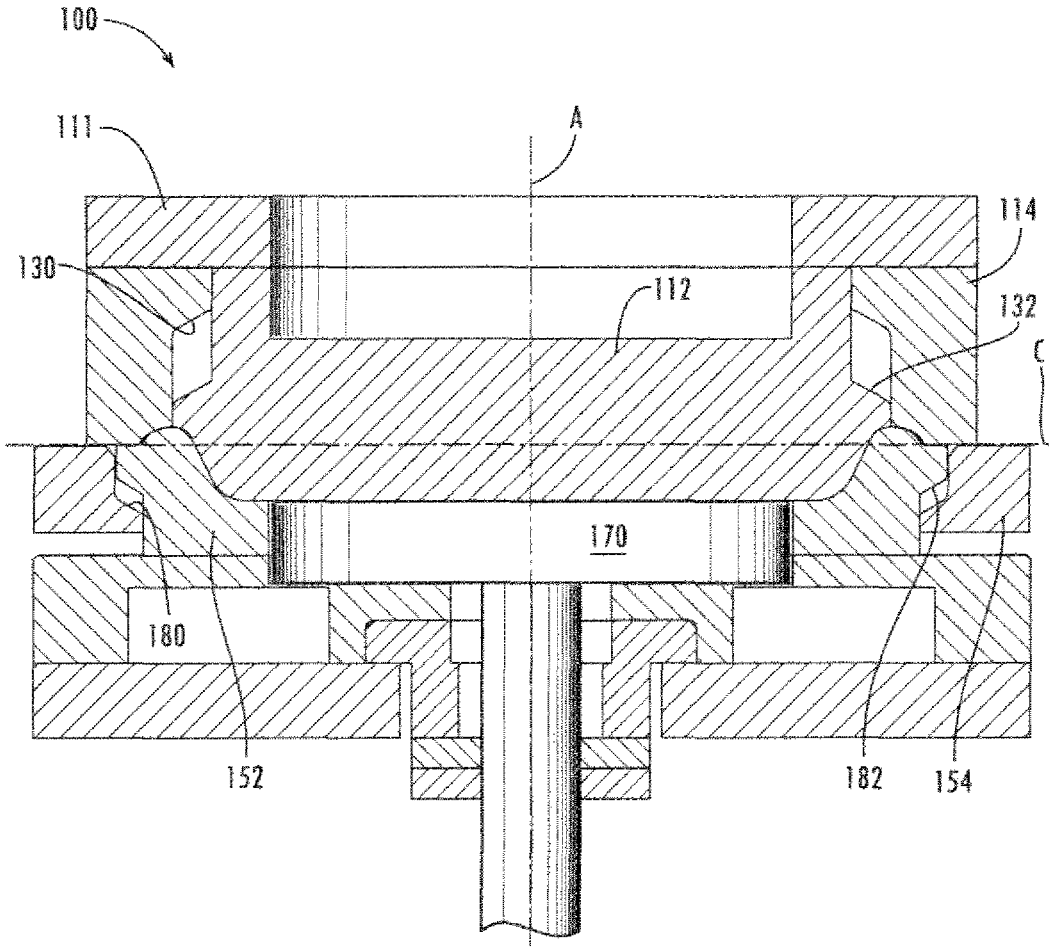
FIG. 5 shows the forming die assembly of FIG. 4 in a closed configuration.
Figure 6:
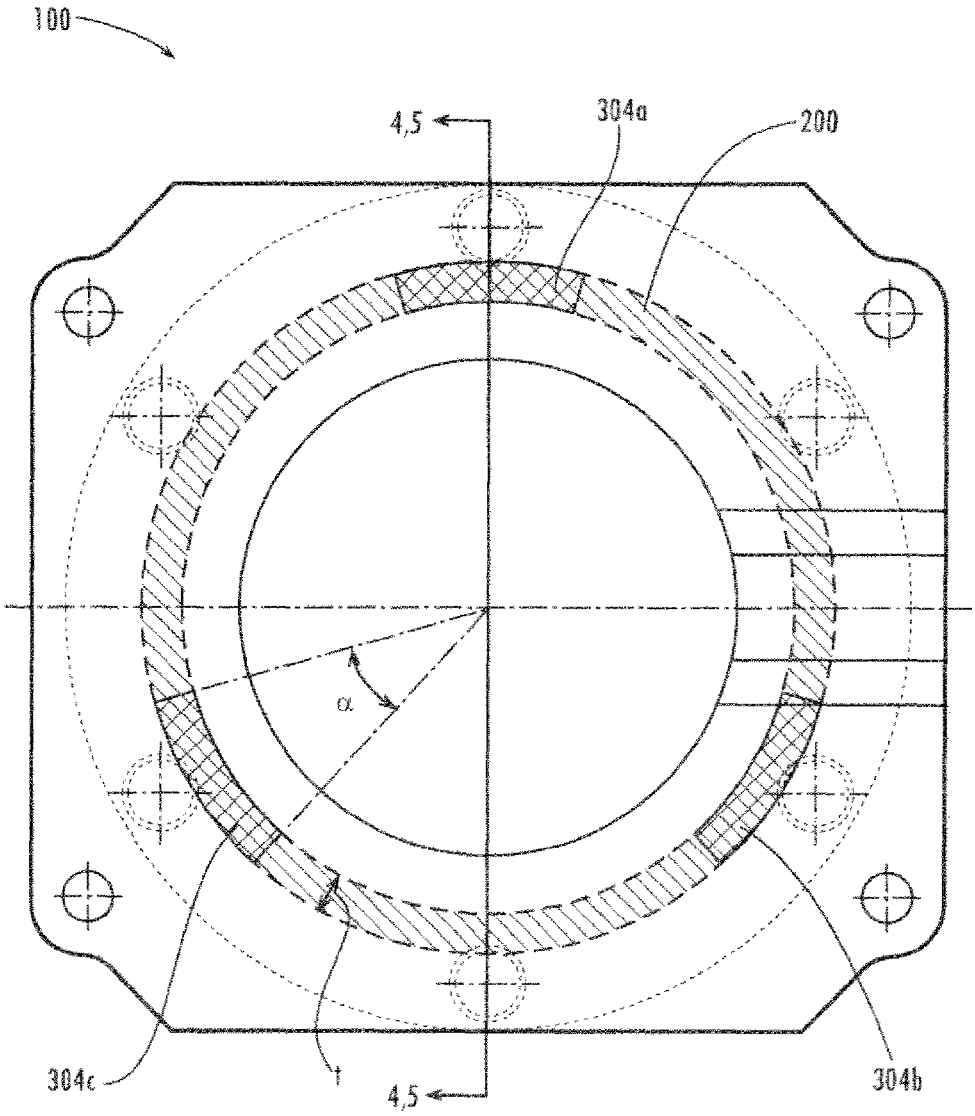
FIG. 6 shows the forming die assembly of FIG. 4 in plan view, with the contact area of the improved stop component(s) of the present invention cross-hatched for emphasis.

An example embodiment of a forming die assembly 100 according to the present invention is shown in FIGS. 4-6. The forming die assembly 100 preferably generally comprises an upper die half 110 and a lower die half 150, shown in an open configuration wherein the upper and lower die halves are disengaged in FIG. 4, and in a closed configuration wherein the upper and lower die halves are engaged in FIG. 5. One or more such forming die assemblies are preferably oriented on an inclined plane within a forming press system, such that scored paperboard blanks are sequentially fed by gravity between the upper and lower die halves 110, 150. The forming press system is cyclically actuated, for example hydraulically or pneumatically, and pressure as well as heat and/or moisture are applied between the upper and lower die halves 110, 150 in a controlled manner to form the paperboard blanks into a shaped paperboard product such as a plate, bowl, platter or other container. Although described herein primarily with reference to paperboard products, the invention is not limited to such, and improved die assemblies according to the present invention may also find application in the production of pulp-molded, plastic or other types of products.

The upper die half 110 preferably generally comprises a punch base 111, a male inner die member or punch 112, and an upper outer die ring or pressure ring 114. The punch 112 preferably has a generally convex shaping face 116 defining a curved or shaped profile conforming to the desired product geometry. The pressure ring 114 optionally also includes a shaping face portion 118 for assisting in crimping and forming the rim and edge profile of the product, and/or an engagement face portion 120 for pleating control and gripping the edge of the blank to maintain centering during product formation. The pressure ring 114 is reciprocally mounted about the punch 112, and one or more springs 121 are engaged therebetween to bias the pressure ring in the direction of the shaping face 116 of the punch, toward the extended position shown in FIG. 4. As the die assembly is closed during operation, the pressure ring moves into the retracted position shown in FIG. 5, compressing the springs. A close running tolerance is preferably provided to maintain coaxial alignment between the punch 112 and the pressure ring 114 about a translational axis A along the extension and retraction strokes of the pressure ring along the punch. Punch base 111 limits travel of the pressure ring 114 at the retracted position, and optionally is separable from the contour of punch 112 for installation and removal of the pressure ring 114.

The lower die half 150 preferably generally comprises a female inner die member or die 152, and a lower outer die ring or draw ring 154. The die 152 preferably has a generally concave inner shaping face 156 and an outer rim shaping face 158 defining a curved or shaped profile conforming to the desired product rim geometry. The draw ring 154 preferably includes a chamfered inner rim 160 to assist in centering the blanks as they are fed into the die assembly, and an engagement face 162 for contact with the engagement face 120 of the pressure ring 114. The draw ring 154 is reciprocally mounted about the die 152, and one or more springs 164 are engaged therebetween to bias the draw ring in the direction of the shaping face 156 of the die, toward the extended position shown in FIG. 4. As the die assembly is closed during operation, the draw ring moves into the retracted position shown in FIG. 5, compressing the springs. A close running tolerance is preferably provided to maintain coaxial alignment between the die 152 and the draw ring 154 about the translational axis A along the extension and retraction strokes of the pressure ring along the punch. One or more knockout portions 170 are optionally reciprocally mounted within the lower die half 150 to assist in product formation and removal from the die 152, in known fashion.

The present invention also encompasses embodiments wherein the upper die half comprises the female die, and the lower die half comprises the male punch. Also, it is to be understood that the outer die rings and inner die members of the present invention can be rectangular, square, triangular, polygonal, or otherwise configured, depending on the shape of the desired product, and are not limited the circular examples shown in the depicted embodiments.

The forming die assembly 100 of the present invention preferably further comprises an improved stop mechanism for limiting the travel of the outer die rings of either or both die halves along the inner die members at their extended positions. For example, the upper die half 110 can incorporate the improved stop mechanism of the present invention between the punch 112 and the pressure ring 114; and/or the lower die half 150 can incorporate the improved stop mechanism of the present invention between the die 152 and the draw ring 154.

In the example embodiments of FIGS. 4-6, 9 and 11, the discrete stop mechanism of the present invention comprises the provision of an internal contact face of the outer die ring that is inclined at an oblique angle (i.e., neither parallel nor perpendicular) relative to the translational axis A of the outer die ring along the inner die member. Or, defined in another manner, the internal contact face of the outer die ring is inclined at an oblique angle relative to a plane of contact C between the upper and lower die halves, and/or relative to a contact surface B defined between the inner die member and the outer die ring. For example, in the embodiment of FIGS. 4-6, the outer die ring of the upper die half 110 (i.e., the pressure ring 114) comprises an angularly inclined internal contact face 130, and the outer die ring of the lower die half 150 (i.e., the draw ring 154) comprises an angularly inclined internal contact face 180.

When the forming die assembly 100 is opened and the outer die rings move into their extended positions, abutment of the angularly inclined internal contact face of the outer die ring against a confronting portion of the peripheral face of the inner die member under the bias of the springs (unshown) will tend to center the outer die ring relative to the inner die member at the beginning of each compression stroke, thereby better maintaining alignment of the die components and avoiding off-center draw against the paperboard blanks. As a result, the improved stop mechanism of the present invention enables more consistent quality control of the product's rim and edge formation. The improved alignment of die components may also reduce wear and resulting maintenance requirements.

Example embodiments of the improved stop mechanism of the present invention preferably further comprise the provision of the external peripheral face of the inner die member with an angularly inclined portion that is complementary to the angularly inclined internal contact face of the corresponding outer die ring. For example, in the embodiment of FIGS. 4-6, the inner die member of the upper die half (i.e., the punch 112) comprises an angularly inclined external peripheral face 132, and the inner die member of the lower die half (i.e., the die 152) comprises an angularly inclined external peripheral face 182. In this manner, the confronting stop surfaces of the inner die member and the outer die ring matingly engage one another in a nesting fashion when the outer die ring moves into its extended position, thereby providing further improved alignment of the die components. By way of explanation, in an example embodiment of the invention wherein the desired product is a circular plate or bowl, the die members may have contact faces that are generally circular in plan view (shown in FIG. 6 as the single cross-hatched portion 200), and their angularly inclined surfaces of contact will form a segment of a cone having its apex along the translational axis A.

In the non-continuous stop aspect of the present invention, the angle of inclination of the contact faces is preferably specifically from about 5° to about 85°, or from about 15° to about 75°, or from about 25° to about 50° relative to the translational axis A. The provision of angled contact faces between the die components in this manner results in a greater surface area of contact between the stop surfaces, relative to a perpendicular stop surface spanning an equal horizontal distance. For example, a 45° angle of inclination will result in a contact length that is at least 1.41 times the relative contact length of a non-angled stop surface. By distributing the contact force over a greater surface area, resulting wear is decreased, thereby further reducing maintenance costs and downtime. Or alternatively, an equal surface area of contact can be obtained in a narrower horizontal span of the stop. Optionally, at least the contact face portions of the die components comprising the stop mechanism are formed of like materials or materials of like hardness, for example of ductile iron, to equalize wear resulting from contact therebetween. Alternatively, materials of differing hardness can be utilized, whereby the softer material forms a sacrificial component to control the manner in which wear occurs.

Figure 3:
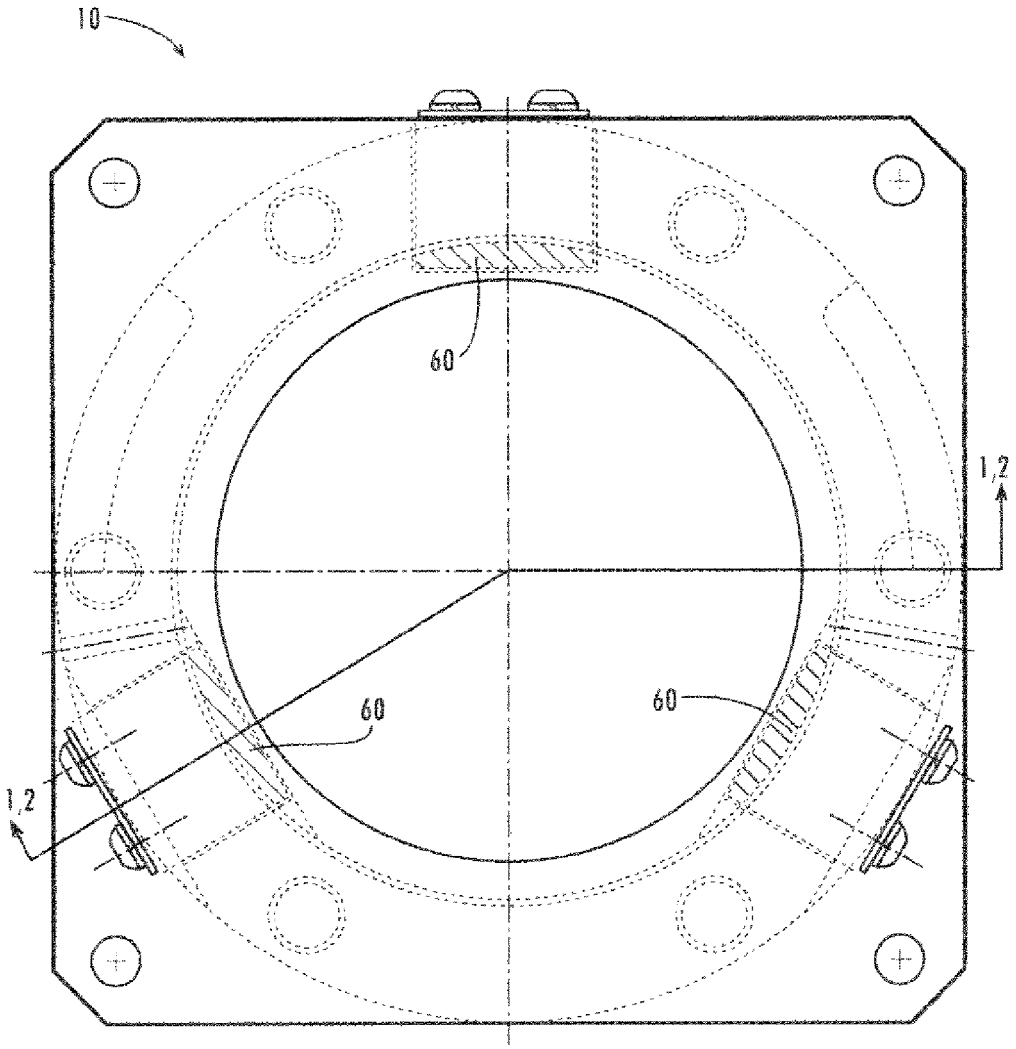
(PRIOR ART) Fig. 3
FIG. 3 shows the forming die assembly of FIG. 1 in plan view, with the contact area of known stop components of the press cross-hatched for emphasis.
Figure 7:
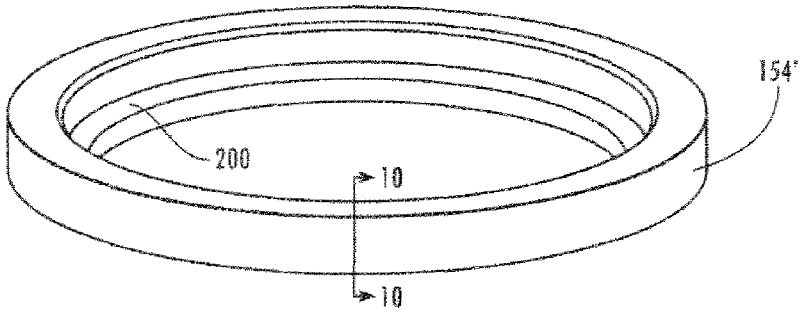
FIG. 7 shows an outer die ring according to an example embodiment of the present invention, having a continuous ring stop.

In further example embodiments of the invention, the surface area of contact between stop surfaces is increased by the provision of stop surfaces comprising ring stops extending substantially continuously around the entire periphery, or around substantially the entire periphery, of the outer die ring(s) and/or the inner die member(s), as seen with reference to FIGS. 6 and 7. This can readily be appreciated by comparing the relatively small contact areas 60 of the discrete chordal stops of previously known (non-angled) die assemblies shown cross-hatched in FIG. 3, with the considerably larger continuous ring stop contact area 200 of the present invention shown single cross-hatched in FIG. 6. For example, in a typical press for forming a 9" circular plate, contact areas 60 of previously known non-angled discrete stops may have a combined surface area of about 1.5 square inches, whereas the contact area 200 of an example continuous ring stop of the present invention may be about 7.2 square inches.

Figure 8:
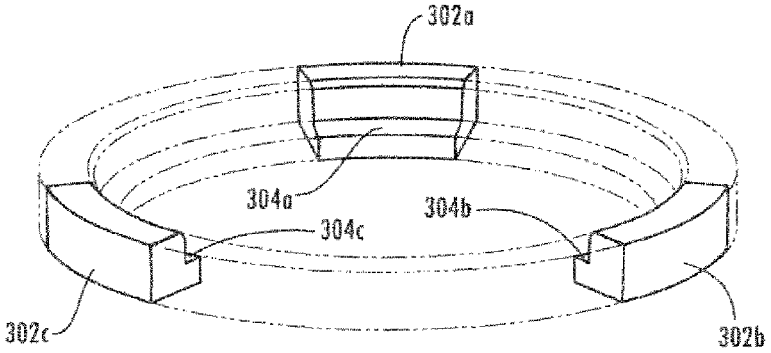
FIG. 8 shows three co-radial stop members, according to another example embodiment of the present invention.

But even in embodiments of the present invention not comprising continuous ring stops, increased surface area of contact between stop surfaces is provided, relative to that of previously known die assemblies, by the provision of one or more co-radial stop members having annular or arcuate contact faces, as shown in FIG. 8. In various embodiments of the invention, the co-radial stop member(s) can be separate components mounted to the outer die ring and/or the inner die member, or can comprise integral portions of the outer die ring and/or the inner die member. As seen with reference to the double-cross-hatched contact areas 304*a*, 304*b* and 304*c* superimposed on FIG. 6, by conforming the stop surfaces to the peripheral contour of the die components, the stops' overall surface area of contact is maximized for a given span $\alpha$, and is greater than the surface area of previously known chordal stop surfaces 60 (FIG. 3) spanning a like angle of inclusion. For circular die configurations, the annular contact face of each co-radial stop member preferably comprises a radial segment of a circular ring having a thickness t, and preferably spanning an included angle $\alpha$ of at least about 15°. For non-circular die configurations, the annular contact face of each circumferential stop member will comprise a segment of a non-circular ring corresponding to the particular product shape. Preferably, at least three co-radial stop members are provided, spaced evenly about the circumference of the die. Since the additional material available for contact is increased when using at least three co-radial stops, the angle of inclination can be from about 1° to about 179° as with the continuous ring stops. From about 25° to about 50° is preferred.

In its various forms, the improved stop mechanism of the present invention increases the surface area of contact relative to previously known (non-angled) stops, and thereby decreases wear, through the provision of one or more stop member(s) having an angularly inclined contact face; and/or one or more continuous ring stop member(s); and/or one or more stop member(s) having an annular contact surface. Enhanced surface area of contact can be achieved in example embodiments including any of these methodologies independently, or in any combination thereof. For example, the embodiment of the invention depicted in FIGS. 4-6 includes continuous ring stop members having angularly inclined contact faces and annular surfaces of contact. In an alternate embodiment of the invention shown in FIGS. 7 and 10, an enhanced surface area of contact 200 is provided by a continuous ring stop (in this case a draw ring 154') having an approximately horizontal contact face. That is, when the continuous ring stop is present, the ring stop can be angled at anywhere from about 1° to about 179°, through and including 90°. And in another embodiment of the invention shown in FIG. 8, enhanced surface area of contact is provided by discrete (i.e., non-continuous) stop members 302*a*, 302*b*, and 302*c*, having annular surfaces of contact 304*a*, 304*b*, and 304*c*, without angularly inclined contact faces. Of course, while enhanced surface area of contact is provided by a continuous ring stop or by annular surfaces of contact without angularly inclined contact faces, the contact area is still further enhanced by providing such stop members with angularly inclined contact faces, as shown in the alternate cross-sectional stop profiles of FIGS. 9 and 11.

Figure 9:
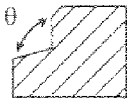
FIGS. 9-11 show cross-sectional views of alternate embodiments of stop geometries, according to further example embodiments of the present invention.
Figure 10:
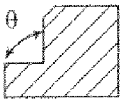
Figure 11:
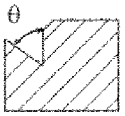

In the present invention using the discrete (non-continuous stops), the angle of inclination $\theta$ of the inclined contact faces is not about 90°, since prior art discrete stops were about 90°. The inventors believed that the benefits of the present invention can be realized with discrete ring stops when such stops are angled at from about 1° to about 85° and from about 95° to about 179°, where the angle of inclination is measured relative to the vertical. Still further, the discrete ring stops are not angled at from about 85° to about 95° C. Put another way, the angle of inclination for the discrete stops is not about less than 10° or less than about 20° relative to the translational axis of the outer die ring. Suitable angles for the discrete ring stops are shown in FIGS. 9 and 11, but not FIG. 10.

When a continuous or co-radial ring stop is present, the angle of inclination can be from about 1° to about 179°, through and including 90°, where the angle of inclination is measured relative to vertical. Suitable angles for the angled ring stops are illustrated in FIGS. 9, 10 and 11.

While the invention has been described with reference to preferred and example embodiments, it will be understood by those skilled in the art that a variety of modifications, additions and deletions are within the scope of the invention, as defined by the following claims.

What is claimed is:

1. A die set for producing paperboard pressware, comprising:

an inner die member having a concave inner face that is opposite an outer peripheral face having a frusto-conical inclined external face and aligned therewith such that a radial line extending from a central longitudinal axis of the inner die member to the outer peripheral face passes through the concave inner face and the frusto-conical inclined external face; and an outer die ring surrounding the inner die member, the outer die ring having a frusto-conical inner face, wherein the frusto-conical inner face of said outer die ring engages against the frusto-conical inclined external face of said inner die member to limit the travel of the outer die ring relative to the inner die member, and wherein the frusto-conical inclined external face of said inner die member and the frusto-conical inner face of said outer die ring are configured to urge said inner die member and said outer die ring toward alignment upon opening of said die set.

2. The die set of claim 1, wherein the frusto-conical inclined external face continuously extends about the outer peripheral face of the inner die member, and wherein the frusto-conical inner face of said outer die ring continuously extends around the inner face of the outer die ring.

3. The die set of claim 2, wherein the frusto-conical inner face of said outer die ring and the frusto-conical inclined external face of said inner die member are inclined at from about 25° to about 50° with respect to a direction of travel of said outer die ring relative to said inner die member.

4. The die set of claim 3, wherein the frusto-conical inner face of said outer die ring and the frusto-conical inclined external face of said inner die member are formed of materials of like hardness.

5. The die set of claim 4, wherein the frusto-conical inner face of the outer die ring comprises a ring stop formed integrally therein having a substantially continuous contact face and the frusto-conical inclined external face of the inner die member comprises a stop formed integrally therein having a substantially continuous contact face mateable with the substantially continuous contact face of the outer die ring.

6. A die set for producing paperboard pressware, comprising:

a first die half comprising an inner die member having a concave inner face that is opposite an outer peripheral face having a frusto-conical external face and aligned therewith such that a radial line extending from a central longitudinal axis of the inner die member to the outer peripheral face passes through the concave inner face and the frusto-conical external face, and an outer die ring surrounding the inner die member, the outer die ring having a frusto-conical inner face, wherein the frusto-conical inner face of the outer die ring engages against the frusto-conical external face of the inner die member to limit the travel of the outer die ring relative to the inner die member, and wherein the frusto-conical external face of the inner die member and the frusto-conical inner face of the outer die ring are configured to urge the inner die member and the outer die ring toward alignment upon opening of said die set; and a second die half comprising an inner punch having a peripheral face, and a pressure ring surrounding the inner punch, wherein the inner die member of the first die half faces the inner punch to form the die set.

7. The die set of claim 6, wherein the pressure ring has a frusto-conical inner face that engages the peripheral face of the inner punch to limit the travel of the pressure ring relative to the inner punch.

8. The die set of claim 6, wherein the outer die ring and the pressure ring are adapted to engage a pressware blank prior to engagement of the pressware blank by the inner die member and the inner punch.

9. The die set of claim 6, wherein the die set is configured and dimensioned to withstand application of a force of over 6,000 lbs to a pressware blank disposed between the inner die member and the inner punch.

10. The die set of claim 6, wherein the outer peripheral face of the inner die member and the frusto-conical inner face of the outer die ring are formed of materials of like hardness.

11. The die set of claim 6, wherein the frusto-conical external face of the inner die member continuously extends about the outer peripheral face thereof, and wherein the frusto-conical inner face of the outer die ring continuously extends around the inner face thereof.

12. The die set of claim 6, further comprising a knockout mounted within the inner die member, wherein the knockout is adapted to assist in the production and removal of the paperboard pressware from the die set.

13. The die set of claim 6, wherein the inner punch has a continuous surface formed between the peripheral face thereof.

14. The die set of claim 6, wherein the die set is oriented at an inclined angle with respect to a translational axis of the outer die ring.

15. The die set of claim 14, wherein the inclined angle permits feeding pressware blanks to the die set by gravity.

16. A die set for producing paperboard pressware from a paperboard blank, comprising:

an inner die ring having a concave inner face that is opposite an outer peripheral face having a frusto-conical external face and aligned therewith such that a radial line extending from a central longitudinal axis of the inner die ring to the outer peripheral face passes through the concave inner face and the frusto-conical external face;

an outer die ring surrounding the inner die ring, the outer die ring having a frusto-conical inner face, wherein the frusto-conical inner face of the outer die ring engages against the frusto-conical external face of the inner die ring to limit the travel of the outer die ring relative to the inner die ring, and wherein the frusto-conical external face of the inner die ring and the frusto-conical inner face of the outer die ring are configured to urge the inner die ring and the outer die ring toward alignment upon opening of said die set;

an inner punch disposed adjacent the inner die ring, the inner punch having an outer frusto-conical external face; and a pressure ring surrounding the inner punch and having a frusto-conical inner face, wherein the frusto-conical inner face of the pressure ring engages against the outer frusto-conical external face of the inner punch to limit the travel of the pressure ring relative to the inner punch.

17. The die set of claim 16, wherein the outer peripheral face of the inner die ring and the frusto-conical inner face of the outer die ring contact one another when the inner die ring engages the inner punch, and wherein the outer peripheral face of the inner die ring and the frusto-conical inner face of the outer die ring are longitudinally offset from one another when the inner die ring engages the inner punch.

18. The die set of claim 16, wherein the outer die ring is inclined relative to a translational axis of the outer die ring, and wherein the angle of inclination is not less than 10°.

19. The die set of claim 18, wherein the pressure ring is inclined relative to a translational axis of the pressure ring, and wherein the angle of inclination is not less than 10°.

20. The die set of claim 16, wherein the die set is oriented at an inclined angle with respect to a translational axis of the outer die ring, and wherein the inclined angle permits feeding paperboard blanks to the die set by gravity.

* * * * *